United States Patent [19]

Jennings et al.

[11] Patent Number: 4,811,570

[45] Date of Patent: Mar. 14, 1989

[54] SLEEVE ASSEMBLY WITH ATTACHED DUCT AND DRAIN CONNECTIONS FOR A THROUGH THE WALL AIR CONDITIONING UNIT

[75] Inventors: William B. Jennings, Collierville, Tenn.; John Thompson, Marietta; Richmond S. Hayes, Jr., Fayetteville, both of N.Y.

[73] Assignee: Carrier Corporation, Syracuse, N.Y.

[21] Appl. No.: 401,443

[22] Filed: Jul. 26, 1982

[51] Int. Cl.[4] ..... F25D 23/12

[52] U.S. Cl. ..... 62/263; 98/94.2

[58] Field of Search ..... 62/263, 262, 259; 98/40 C, 94 AC; 312/10 C, 101, 213, 242

[56] References Cited

U.S. PATENT DOCUMENTS

| | | | |
|---|---|---|---|
| 1,958,124 | 5/1934 | Bemis . | |
| 2,405,411 | 8/1946 | Dybvig . | |
| 2,559,217 | 7/1951 | Kehoe . | |
| 2,796,822 | 6/1957 | Nikolajevic . | |
| 3,097,506 | 7/1963 | Blakesley, Sr. . | |
| 3,137,226 | 6/1964 | Pietsch . | |
| 3,217,450 | 11/1965 | Brownstein . | |
| 3,225,561 | 12/1965 | Hall, Jr. . | |
| 3,270,518 | 9/1966 | Fugere | 62/263 |
| 3,308,634 | 3/1967 | Smith . | |
| 3,722,580 | 3/1973 | Braver . | |
| 3,729,950 | 5/1973 | Astrom | 62/259.1 |
| 3,974,661 | 8/1976 | Ferdelman et al. . | |
| 4,315,457 | 2/1982 | Lang et al. | 98/40 C X |
| 4,325,594 | 4/1982 | Lang et al. . | |

FOREIGN PATENT DOCUMENTS

| | | | |
|---|---|---|---|
| 1556064 | 11/1979 | United Kingdom | 62/263 |

*Primary Examiner*—Henry A. Bennett

*Attorney, Agent, or Firm*—Dana F. Bigelow

[57] ABSTRACT

A sleeve assembly and an air conditioning unit are disclosed for mounting the air conditioning unit in a through the wall application. The sleeve assembly includes duct connections, drain connections and electrical connections such that during construction of the building all the connections of the air conditioning unit are made to the sleeve. Thereafter, the air conditioning unit may be engaged into the sleeve to complete the installation.

2 Claims, 2 Drawing Sheets

SLEEVE ASSEMBLY WITH ATTACHED DUCT AND DRAIN CONNECTIONS FOR A THROUGH THE WALL AIR CONDITIONING UNIT

BACKGROUND OF THE INVENTION

1. Field of the Invention

This invention in general relates to an air conditioning unit adapted to be mounted through the wall of an enclosure. More particularly, the present invention relates to a sleeve assembly designed to be mounted in the wall for receiving an air conditioning unit extending through the wall.

2. Prior Art

Air conditioning units which are commonly mounted through the wall are used for light commercial and residential applications such as hotels, dormitories, office buildings and apartment buildings and may additionally be used in other applications. The advantage of mounting the air conditioning unit through the wall is that floor space is saved. The mounting of a unit in a basement, a dedicated closet or other similar location occupying valuable floor space is not necessary. By saving floor space, the total space available for renting or for other use is increased. A typical installation might be in an entry closet to an apartment. By making this closet slightly larger the unit may be mounted therein without reducing the available closet space.

In addition, by mounting the unit through the wall it is possible to locate numerous units about an enclosure rather than a single large unit which requires a large amount of duct work to conduct the air to the various areas within an enclosure. In addition, the use of a plurality of units allows for better zone control and for potential improved overall energy efficiency.

When through the wall type units are used in apartment type buildings, it is possible to allow independent heating and cooling control of each unit and consequently energy usage may be metered to each arrangement depending upon the usage of that particular unit.

During the construction of a building utilizing through the wall type units it is necessary to provide openings for installation of the units during erection of the exterior walls. With the arrangement as described herein, a sleeve is inserted through the exterior envelope of the building and the walls are built up around the sleeve such that the sleeve defines an opening extending through the exterior of the building. Finished building interior and exterior walls are constructed around the sleeve.

With previous ducted through the wall units, it was necessary to mount the unit at the time of erection of the building. When the unit itself was placed in the wall it was found that subsequent damage would often occur to the unit during additional construction steps. Additionally, when the units themselves were placed within the wall the building was often not secure and theft problems could occur with the units disappearing during construction.

The present sleeve is designed such that the duct work and drainage systems, as well as the electrical system, may be connected to the sleeve during erection of the building. During this time the sleeve is left in the building defining the opening and no working parts of the air conditioning system are necessary. The duct work may be installed in the ceiling of the space with ducts extending to the appropriate rooms to be conditioned by the unit. Drain connections are made to the sleeve prior to the air conditioning unit even being shipped to the site. The sleeve may include a disposable shipping panel secured to the sleeve in place of the grille. The panel adds structural integrity to the sleeve during shipping and covers the opening after installation to secure the enclosure from weather conditions and discourages unwanted entry into the building during construction.

Also, an electrical power source may be connected to the sleeve. Typically, the cost of the sleeve is significantly less than the cost of the unit such that the builder has much less capital committed during construction by installation of the sleeve alone. Hence, the potential problems of theft and of unit damage are avoided since the building is assembled with only the sleeve in position. The builder then purchases the air conditioning unit for assembly into the sleeve only when the building has reached the stage of completion that it is desirable to do such. With the duct and drain connections already made, a simple electrical plug connected to the unit is connected to an electrical connection of the sleeve, the unit is inserted into the sleeve, a few bolts are utilized to secure the unit, the thermostat is connected and the air conditioning system is in place. Hence, the builder has not tied up his capital in air conditioning units prior to a need to actually install the units to provide conditioning to selected spaces. During construction the units are maintained at a distributor or dealer where they are not subject to damage during construction or to theft.

A further advantage of this type system is that by allowing the sleeve to be installed throughout the building during construction and the building to thereafter be occupied as portions are completed to a tenants individual needs, the builder need only purchase those units necessary to serve the areas occupied. In other words, if only a portion of the building is initially rented and the remainder is rented thereafter the builder need only buy the air conditioning units to service the portions rented. Hence, the builders capital outlay is more closely aligned with actual occupancy of the building and the cash flow of rental income.

SUMMARY OF THE INVENTION

An object of the present invention is to provide a sleeve assembly for receiving a through the wall air conditioning unit.

A further object of the present invention is to provide a sleeve having duct connections designed to be connected to ducts within the building during construction prior to the mounting of the air conditioning unit.

Another object of the present invention is to provide a sleeve assembly including drain connections to be secured into the building during construction prior to the installation of the air conditioning unit.

A further object of the present invention is to provide a safe, economical and easy to assemble means for providing a sleeve assembly to define an opening through the wall of a building and for later mounting an air conditioning unit thereto.

A further object of the present invention is to provide a method of mounting a sleeve assembly to the exterior wall of the building such that an air conditioning unit may thereafter be quickly engaged into position.

It is a further object of the invention to provide apparatus allowing a builder to construct a building with minimum capital requirements by delaying the purchase of air conditioning units until such time as air conditioning is needed for each specific location within the building.

Other objects will be apparent from the description to follow and from the appended claims.

The above objects are achieved according to a preferred embodiment of the invention by the provision of a sleeve assembly for securing an air conditioning unit extending through an opening in an exterior wall of a building. The sleeve assembly includes sleeve walls having a bottom surface, side walls and a top surface, all connected to define a unit receiving opening through which the unit may be mounted. Duct connections are mounted to a portion of the sleeve wall, said connections being adapted to be connected to the duct work of the building for directing conditioned air within the enclosure and being in registration with the supply of conditioned air from the air conditioning unit such that the duct work may be connected to the sleeve assembly prior to the assembly of the unit thereto.

The air conditioning unit and sleeve assembly into which the air conditioning unit may be mounted through the wall include the sleeve assembly having top and bottom surfaces and side walls defining a casing which may be mounted in the wall for the receipt of the air conditioning unit, duct connection means connected to the sleeve assembly and positioned relative to the building for allowing duct work for distributing conditioned air about the building to be connected thereto prior to the assembly of the unit within the sleeve and said air conditioning unit including an indoor fan for circulating air through the duct work, said unit together with the duct connection means defining an air flow path from the indoor fan discharge to the duct work of the building.

DESCRIPTION OF THE PREFERRED EMBODIMENT

The preferred embodiment herein described will refer to a sleeve assembly for use with a heat pump type air conditioning unit designed to be mounted through the wall of a building. It is to be understood that this invention has like applicability to other types of air conditioning units including cooling only or heating only units, fan coils, condensing units and other potentially wall mounted applications wherein the unit may be assembled to a sleeve mounted during construction of the building.

Figure 1:
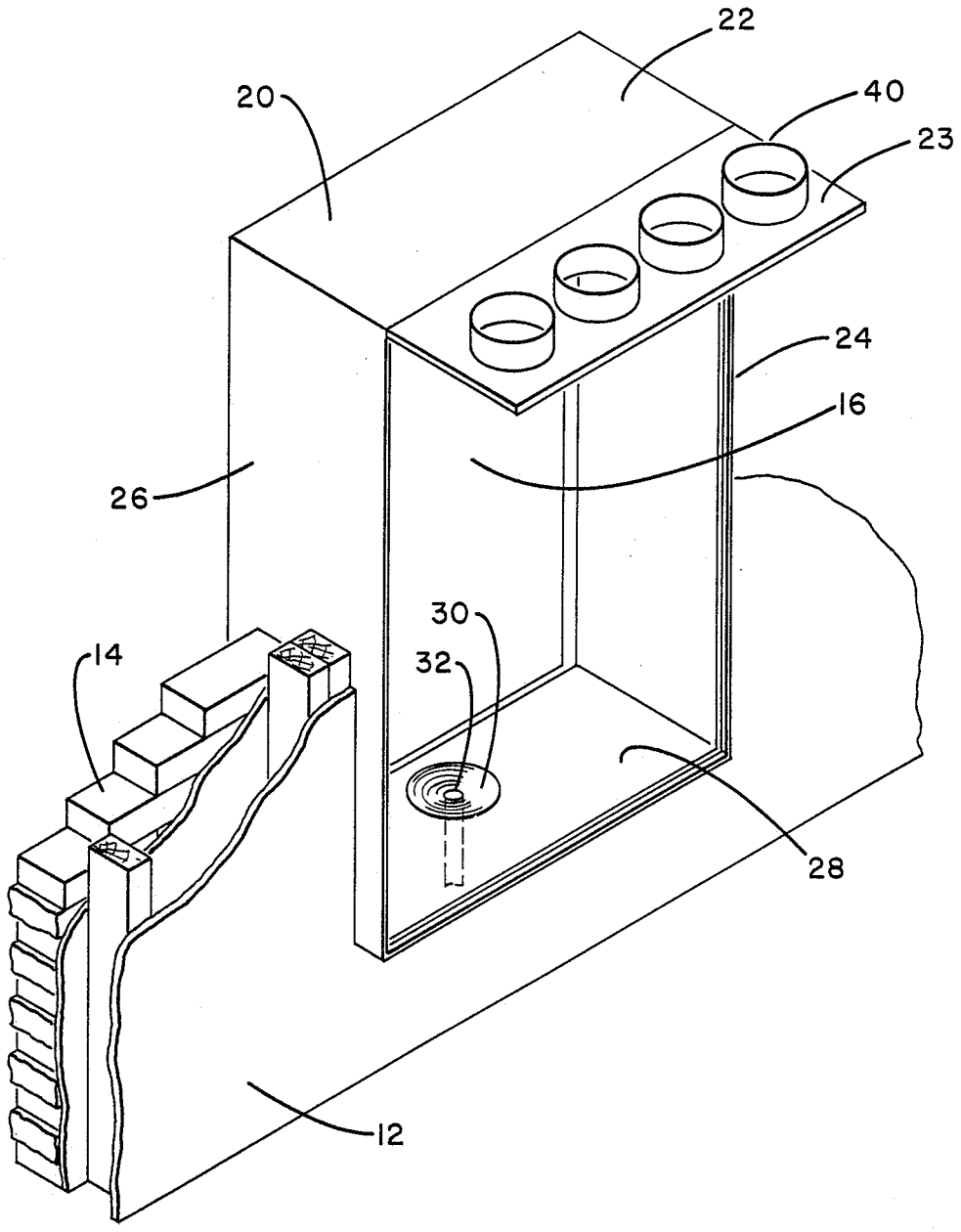
FIG. 1 is a partially cut away view of the sleeve assembly mounted in the exterior wall of the building.

Referring first to FIG. 1 there may be seen a sleeve 20 defining an opening 16 through the wall of the enclosure. The wall of the enclosure is shown as a brick exterior wall 14 and a stud and plasterboard interior wall 12. The sleeve is mounted to extend from the interior of the building to the exterior of the building and may preferably be mounted flush with the building. Sleeve 20 has a top surface 22, side walls 24 and 26 and bottom surface 28 all acting to define opening 16 into which the air conditioning unit may be assembled.

Top surface 22 of sleeve 20 has a top surface extension portion 23 which extends inwardly therefrom and which has duct connectors 40 extending upwardly from the extension portion. Duct connectors 40 are cylindrical in configuration and are designed to be compatible with flexible hose type ducts mounted in the enclosure for directing conditioned air about the enclosure. Top surface 22 may also have tabs (not shown) extending therefrom for engaging a single rectangular duct into which all of the air flow from the unit may be directed.

In the bottom surface 28 of the sleeve assembly there may be seen a drain indentation 30 which slopes downwardly to drain line connection 32 connected to drain line 34. This indentation is adapted to receive, either directly or through a receptacle positioned thereabove, the condensate from the air conditioning unit and to direct that condensate appropriately.

Figure 2:
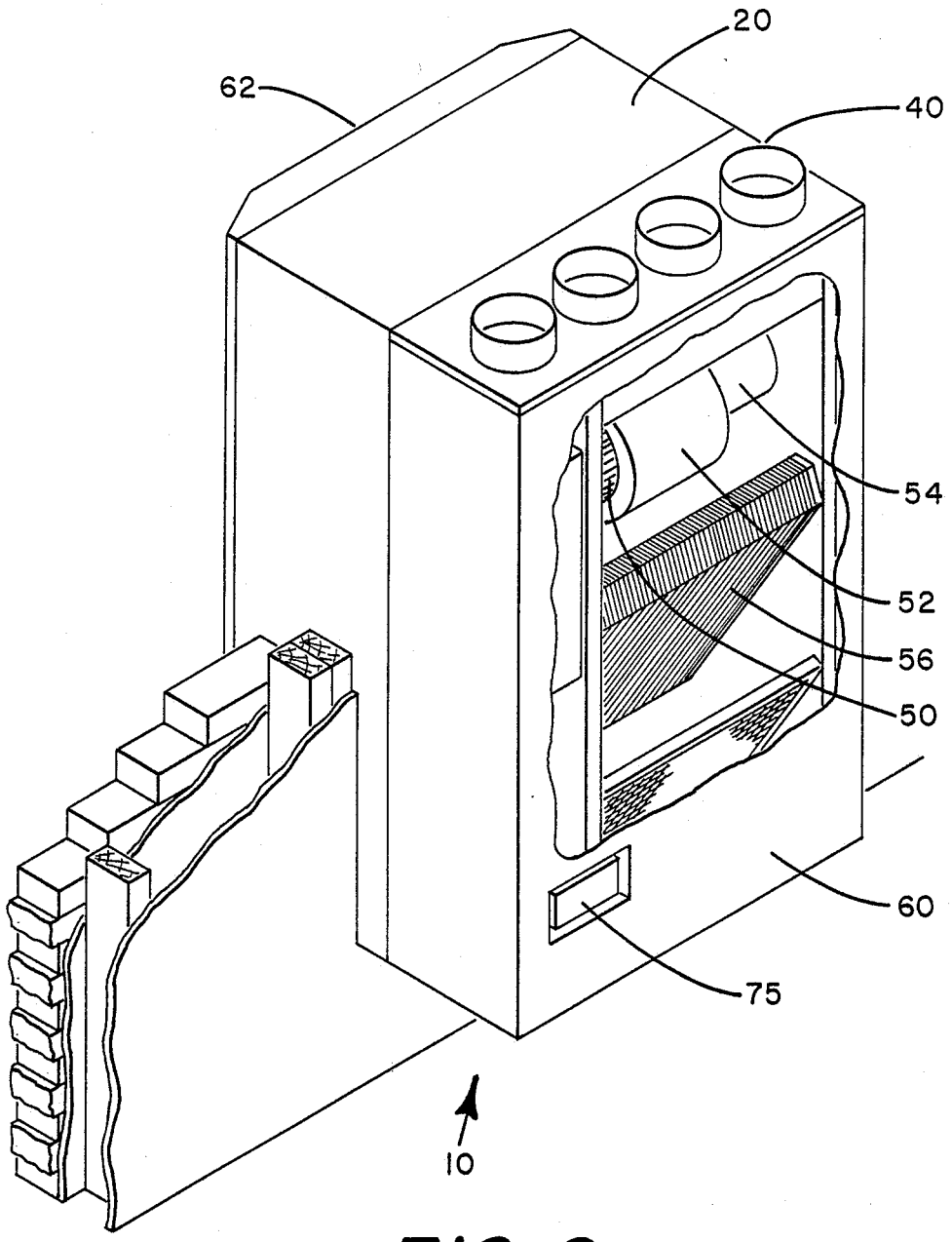
FIG. 2 is a partially cut away view of the sleeve assembly mounted in the exterior wall of the building, as in FIG. 1, with the air conditioning unit mounted therein.

FIG. 2 shows sleeve 20 having air conditioning unit 10 mounted to extend therethrough. Air conditioning unit 10 has a partially cut away front cover 60 and disclosing a segment of the indoor portion of the air conditioning unit. Within this indoor portion may be seen filter 58, indoor heat exchanger 56 and indoor fan 50 mounted within indoor fan scroll 52 and powered by fan motor 54. Air flow in the indoor portion of the unit is up through the bottom of the unit (not shown), through the filter, through the indoor heat exchanger 56 and into indoor fan 52. The air is then discharged upwardly again and directed out the four duct connectors 40 into the duct work serving the enclosure. It is anticipated that a flexible duct would be connected to each of the four duct connectors 40, said flexible duct running to the appropriate location within the building where the conditioned air is desired. Thermostat 75 may be mounted within the unit or remotely mounted on a wall for sensing the temperature of the air in the room and for appropriately energizing the unit. The thermostat may be connected to the air conditioning unit with a plug type connector to facilitate either remote mounting or the thermostat being contained within the unit. If the thermostat is mounted remotely a connecting line with appropriate connectors may be placed in the wall of the building during construction such that the connectors are engaged to complete the thermostat stat wiring upon unit installation. The outdoor section of the unit, although not shown, will include a compressor, outdoor coil and four way valve. Grille 62 is shown covering the exterior surface of the unit.

During cooling operations, condensate may collect on the indoor heat exchanger. This condensate is collected in a condensate drip pan as is conventional in the art and is directed to the drain arrangement as may be seen in FIG. 1. During heating operations, frost may collect on the outdoor heat exchanger serving as an evaporator and during the defrost mode this frost is melted. Again, this water is conducted to the drain connection at the bottom of the unit. The drain connection will direct the condensate into a disposal system such that the condensate does not drip down the outside of the building.

Although not shown, electrical connections may be made to the sleeve when the sleeve is assembled into the building and a plug connection is thereafter made when the unit is assembled into the sleeve. Again, not shown, a simple screw arrangement may secure the unit in the sleeve when mounted. Hence, as has been described herein, once the sleeve assembly is mounted into the wall the drain connections, electrical connections and duct connections are all made. It is expected that the duct connections will be hidden behind a vertical wall forming a portion of the enclosure such that they are not observable or that the unit will be mounted flush with the ceiling so no such enclosure is necessary. Hence, the unit as is shown in FIG. 2 will extend outwardly from the wall. Directly above the unit the wall of the enclosure will be built outwardly flush with cover 60 of the unit to encase the duct work of the enclosure and the duct connections. This outward wall portion will extend to the ceiling giving a clean appearance to the installation. The electrical, duct work and drain connections are all made prior to assembly of the unit such that the unit may be simply inserted within the sleeve when it is desired to be capable of providing air conditioning to the space. If it is desired to leave the space open for a brief period it is possible to merely cover the sleeve to prevent ambient air from entering the building.

The invention has been described herein with reference to a particular embodiment thereof. It is to be understood that variations and modifications can be effected within the spirit and scope of the invention.

What is claimed is:

1. A sleeve assembly for securing an air conditioning unit extending through an opening in an exterior wall of a building, comprising:

a sleeve assembly including a bottom wall, side walls and a top wall all connected to define a unit receiving opening through which the unit may be mounted;

duct connections mounted to a portion of the sleeve assembly, said connections being adapted to be connected to duct work of the building for directing conditioned air within an enclosure and being in registration with a supply of conditioned air from the air conditioning unit such that the duct work may be connected to the sleeve assembly prior to the assembly of the unit into the sleeve assembly; and a condensate collection means associated with the bottom wall, said means located relative to the unit when assembled to receive condensate from the unit and including an indentation formed in the bottom wall, said indentation including an opening at the bottom thereof for connection to a drainage conduit.

2. An air conditioning unit and sleeve having top and bottom walls and side walls for mounting the air conditioning unit in the wall of a building, comprising:

duct connection means connected to the sleeve and positionable relative to the building for allowing duct work for distributing conditioned air about the building to be connected thereto prior to assembly of the unit within the sleeve;

said air conditioning unit including an indoor fan for circulating air through the duct work, said unit together with the duct connection means when the unit is mounted in the sleeve defining in air flow path from the indoor fan discharge to the duct work of the building;

wherein the sleeve bottom wall includes condensate collection means and wherein the air conditioning unit includes condensate disposal means located in registration with the condensate collection means when the unit is mounted in the sleeve assembly and further wherein the condensate collection means includes a funnel shaped means connected at the bottom thereof to a condensate disposal conduit.

* * * * *